United States Patent [19]

Weaver et al.

[11] 4,141,677

[45] Feb. 27, 1979

[54] SCROLL-TYPE TWO STAGE POSITIVE FLUID-DISPLACEMENT APPARATUS WITH INTERCOOLER

[75] Inventors: H. William Weaver; Robert W. Shaffer, both of Campbellsville, Ky.

[73] Assignee: Ingersoll-Rand Company, Woodcliff Lake, N.J.

[21] Appl. No.: 824,749

[22] Filed: Aug. 15, 1977

[51] Int. Cl.[2] ..... F04C 23/00; F04C 17/02

[52] U.S. Cl. ..... 418/6; 418/55; 418/59

[58] Field of Search ..... 418/6, 55, 59

[56] References Cited

U.S. PATENT DOCUMENTS

| | | | |
|---|---|---|---|
| 940,817 | 11/1909 | McLean et al. | 418/6 |
| 1,376,291 | 4/1921 | Rolkerr | 418/6 |
| 3,994,633 | 11/1976 | Shaffer | 418/5 |

*Primary Examiner*—Carlton R. Croyle
*Assistant Examiner*—Leonard E. Smith
*Attorney, Agent, or Firm*—Bernard J. Murphy

[57] ABSTRACT

The invention comprises a positive fluid displacement apparatus of the scroll type described as a fluid compressor in the exemplary embodiment. The embodiment has single fixed and movable scroll elements in which the latter orbits the former to form variable volume pockets which move from an inlet to an outlet and means are provided for discharging fluid from at least one of the pockets prior to its movement to the outlet port, cooling the vented fluid and returning it to the apparatus for final compression and discharge. Accordingly, by this arrangement, two stages of compression with intercooling are provided in a single apparatus having only a single fixed scroll element and a single movable scroll element.

12 Claims, 7 Drawing Figures

SCROLL-TYPE TWO STAGE POSITIVE FLUID-DISPLACEMENT APPARATUS WITH INTERCOOLER

This invention pertains to fluid displacement apparatus and more particularly to apparatus, for handling fluids to compress, expand or pump same, of the "scroll" type. Such apparatus comprises the use of scroll members which make moving contacts to define moving isolated volumes, called "pockets", which carry the fluid to be handled from a first zone in the apparatus, whereat a fluid inlet is provided, to a second zone in the apparatus, whereat a fluid outlet is provided. The contacts which define these pockets formed between scroll members are of two types: line contacts between spiral cylindrical surfaces, and area contacts between plane surfaces. The volume of a sealed pocket changes as it moves. At any one instant of time, there will be at least one sealed pocket. When there are several sealed pockets at one instant of time, they will have different volumes, and in the case of a compressor or expander, they will also have different pressures.

Devices of this type, generally referred to as "scroll" pumps, compressors and engines, have two interfitting spiroidal or involute spiral elements of like pitch which are mounted on separate end plates. These spirals are angularly and radially offset to contact one another along at least one pair of line contacts such as between spiral cylinders. The pair of line contacts will lie approximately upon one radius drawn outwardly from the central region of the scrolls. The fluid volume so formed therefore extends all the way around the central region of the scrolls. In certain special cases the pocket or fluid volume will not extend the full 360° but because of special porting arrangements will subtend a smaller angle about the central region of the scrolls. The pockets define fluid volumes which vary with relative orbiting of the spiral centers while maintaining the same relative spiral angular orientation. As the contact lines shift along the scroll surfaces, the pockets thus formed experience a change in volume. The resulting zones of lowest and highest pressures are connected to fluid ports.

With respect to positive fluid displacement gas compressors, of high capacity and/or high pressure capability, discharge temperatures tend to be inordinately elevated. Accordingly, it is customary to use two or more stages of compression, with intercooling and aftercooling, to control discharge temperatures. In this, then, the compressed gas product of a first-stage compressor assembly is cooled and conducted to a second-stage compressor assembly, and so on — as required. In scroll machines, as in other types of positive fluid displacement apparatus, a plurality of staging assemblies requires the duplication or addition of compressing elements or components. Scroll machines, perhaps more so than other types of positive fluid displacement apparatus, reflect high costs of manufacture and maintenance, as the number of scroll elements multiply. In order to accommodate high capacity and/or high pressure in a scroll type positive fluid displacement apparatus, it is desirable, if possible, to use only one set of scroll elements.

It is object of this invention to set forth an improved, scroll-type, positive fluid displacement apparatus, having means defining a circular and walled, fluid-working chamber, at least one fixed and one movable scroll-shaped, fluid-working element within said chamber, a first port opening into, and substantially centrally of, said chamber, a second port opening into said chamber radially outwardly-spaced from said first port, and means coupled to said one movable scroll-shaped, fluid-working element for moving the latter in an orbit relative to, and interfitting with, said fixed element, to effect moving line contacts between said elements which define inter-element, walled, variable-volume pockets which, during orbit, close off, and move progressively and circularly, from said second port toward said first port for opening of said pockets onto, and for communication thereof with, said first port, wherein the improvement comprises:

means, intermediate of, and spaced-apart from, both said first and second ports, for venting fluid from at least one of said pockets; and means, intermediate of, and spaced-apart from both said first and second ports, for introducing fluid into at least one other of said pockets prior to a communication of said other pocket with said first port; wherein an end of said one movable element terminates in adjacency to at least one of said fluid-venting and fluid-introducing means, said end, during orbit thereof, moves along a circular path having a given diameter, and said end slidably and sealingly effects and maintains a line contact with a surface formed on said other fixed element, during a given portion of movement of said end about approximately 90° of said orbit, to cause given ones of said pockets, which are defined and sealingly closed off by said line contact between said surface of said fixed element and said end of said one movable element, each to experience an opening thereof, onto said one of said fluid-venting and fluid-introducing means, which is delayed a period of time which substantially corresponds with the time transpiring during said 90° of orbit.

It is also an object of this invention to disclose an improved, scroll-type, positive fluid displacement apparatus, having means defining a circular and walled, fluid-working chamber, at least one fixed and one movable scroll-shaped, fluid-working element within said chamber, a first port opening into, and substantially centrally of, said chamber, a second port opening into said chamber radially outwardly-spaced from said first port, and means coupled to said one movable scroll-shaped, fluid-working element for moving the latter in an orbit relative to, and interfittingly with, said fixed element, to effect moving line contacts between said elements which define inter-element, walled, variable-volume pockets which, during orbit, close off, and move progressively and circularly, from one of said ports toward the second of said ports for opening of said pockets onto, and for communication thereof with, said second port, wherein the improvement comprises:

means, intermediate of, and spaced-apart from, both said first and second ports, for venting fluid from at least one of said pockets; and means, intermediate of, and spaced-apart from, both said first and second ports, for introducing fluid into at least one other of said pockets prior to a communication of said other pocket with said second port; wherein an end of said one movable element terminates in adjacency to at least one of said fluid-venting and fluid-introducing means, said end, during orbit thereof, moves along a circular path having a given diameter, and said end slidably and sealingly effects and maintains a line contact with a surface formed on said other fixed element, during a given portion of movement of said end about approximately 90° of said orbit, to cause given ones of said pockets, which are defined and sealingly closed off by said line contact between said surface of said fixed element and said end of said one movable element, to experience a closure thereof, to said one of said fluid-venting and fluid-introducing means, which is advanced a period of time which substantially corresponds with the time transpiring during said 90° of orbit.

Further objects of this invention, as well as the novel features thereof, will become more apparent by reference to the following description taken in conjunction with the accompanying figures, in which.

Figure 1:
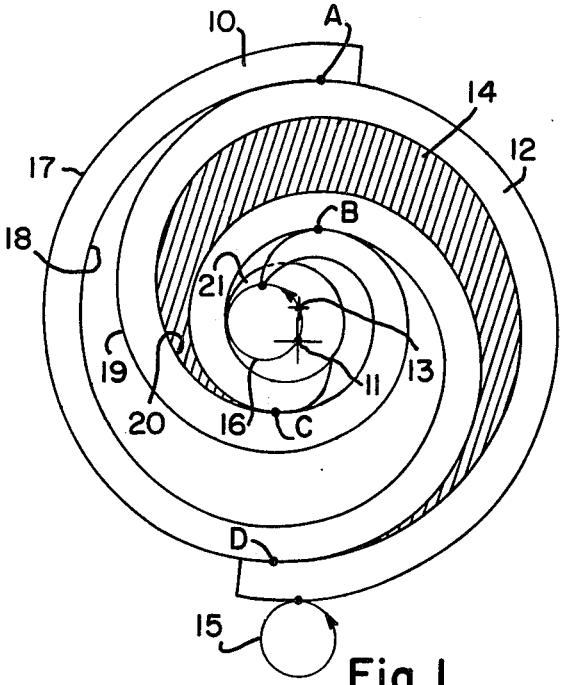
FIGS. 1–4 are diagrammatic illustrations of prior art scroll machines depicting the significant portions of scroll elements and showing, in progressive development, how such elements compress gas.
Figure 2:
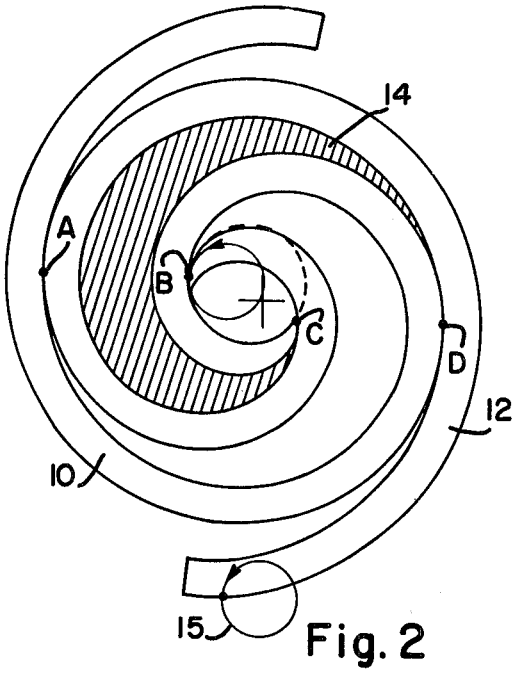

Before describing a specific embodiment of the apparatus of this invention, the principles of operation of "scroll" apparatus may be discussed briefly in order to understand the way in which positive fluid displacement is achieved. The scroll-type apparatus operates by moving a sealed pocket of fluid taken from one zone within the apparatus into another zone which may be at a different pressure. If the fluid is moved from a lower to higher pressure zone, the apparatus serves as a compressor; if from a higher to lower pressure zone, it serves an an expander; and if the fluid volumes remain essentially constant, then the apparatus serves as a pump.

The sealed pocket of fluid is bounded by two parallel planes defined by end plates, and by two cylindrical surfaces defined by the involute of a circle or other suitably curved configuration. The scroll members are aligned on parallel axes. A sealed pocket moves along between these parallel planes as the two lines of contact between the cylindrical surfaces move. The lines of contact move because one cylindrical element, e.g., a scroll member, moves over the other. This may be accomplished by maintaining one scroll member fixed and orbiting the other scroll member or by rotating both of the two scroll members on their parallel axes. In the detailed discussion which follows, it will be assumed for the sake of convenience that the positive fluid displacement apparatus is a compressor and that one scroll member is fixed while the other scroll member orbits in a circular path.

FIGS. 1–4 may be considered to be end views of a compressor wherein the end plates are removed and only the involutes of the scroll members are shown. In the descriptions which follow, the term "scroll member" or "scroll element" will be used to designate a component which is comprised of both an end plate and elements which define contacting surfaces which make movable line contacts. The involutes of the scroll elements have a configuration, e.g., an involute of a circle (involute spiral), arc of a circle, etc., and they have both height and thickness. The thickness may vary over the length of the spiral.

In the diagrams of FIGS. 1–4, a stationary scroll member 10 in the form of an involute spiral having axis 11 and a movable scroll member 12 in the form of another involute spiral of the same pitch as spiral 10 and having axis 13 constitute the components which define the moving sealed fluid pocket 14 which is cross-hatched for ease of identification. As will be seen in FIG. 1, the two scroll members can be made to touch at a number of points, for example in FIG. 1, the points A, B, C and D. These points are, of course, the line contacts between the cylindrical surfaces previously described. It will be seen that line contacts C and D of FIG. 1 define the cross-hatched pocket 14 being considered. These line contacts lie approximately on a single radius which is drawn through point 11, thus forming pocket 14 which extends for approximately a single turn about the central region of the scrolls. Since the involutes have height (normal to the plane of the drawings) the pocket becomes a fluid volume which is decreased from FIG. 1 to FIG. 4 as the movable scroll member is orbited around a circle 15. Since scroll member 12 does not rotate as it orbits, the path traced out by the walls of member 12 may be, in addition, represented as a circle 16. As illustrated in FIGS. 1–4, scroll member 10 has a shape characterized by two congruent involute spirals 17 and 18 and scroll member 12 has a shape characterized by two congruent involute spirals 19 and 20. The thicknesses of the spiral walls are shown to be identical, although this is not necessary.

Figure 3:
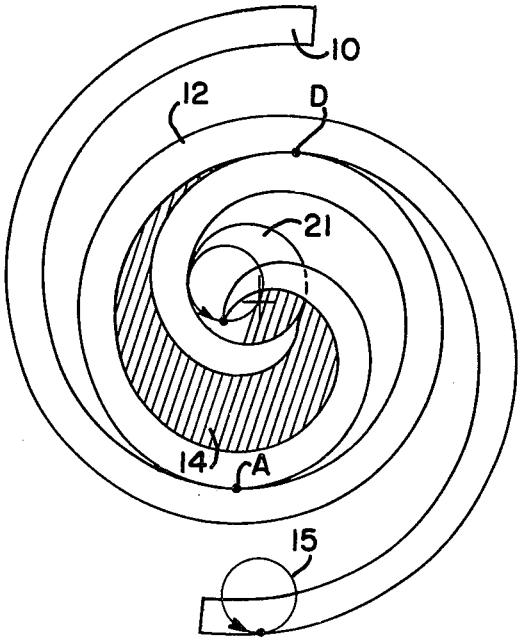
Figure 4:
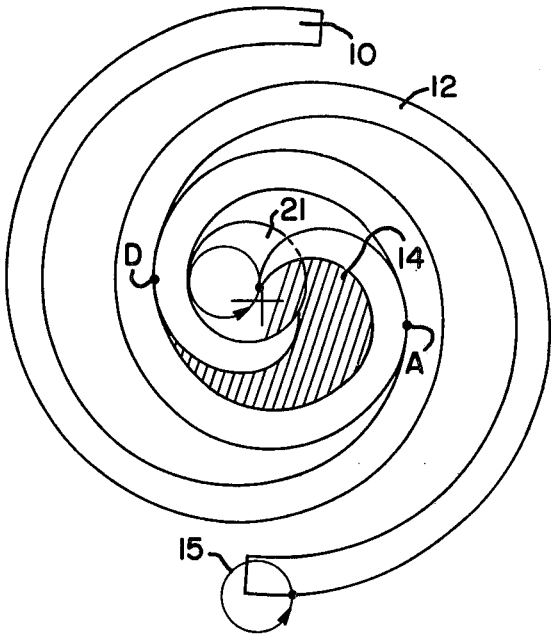

The end plate (not shown in FIGS. 1–4) to which stationary scroll member 10 is fixed has a high-pressure fluid port 21 and as the moving scroll member 12 is orbited the fluid pocket 14 shifts counterclockwise and decreases in volume to increase the fluid pressure. In FIG. 3, the fluid volume is opened into port 21 to begin the discharge of high-pressure fluid and this discharge of the high-pressure fluid is continued as shown in FIG. 4 until such time as the moving scroll member has completed its orbit about circle 15 and is ready to seal off a new volume for compression and delivery as shown in FIG. 1.

If high-pressure fluid is introduced into the fluid port 21, the movable scroll member 12 will be driven to orbit in a clockwise direction under the force of the fluid pressure and will deliver mechanical energy in the form of rotary motion as it expands into fluid pockets of increasing volume. In such an arrangement the device is an expansion engine.

Figure 5:
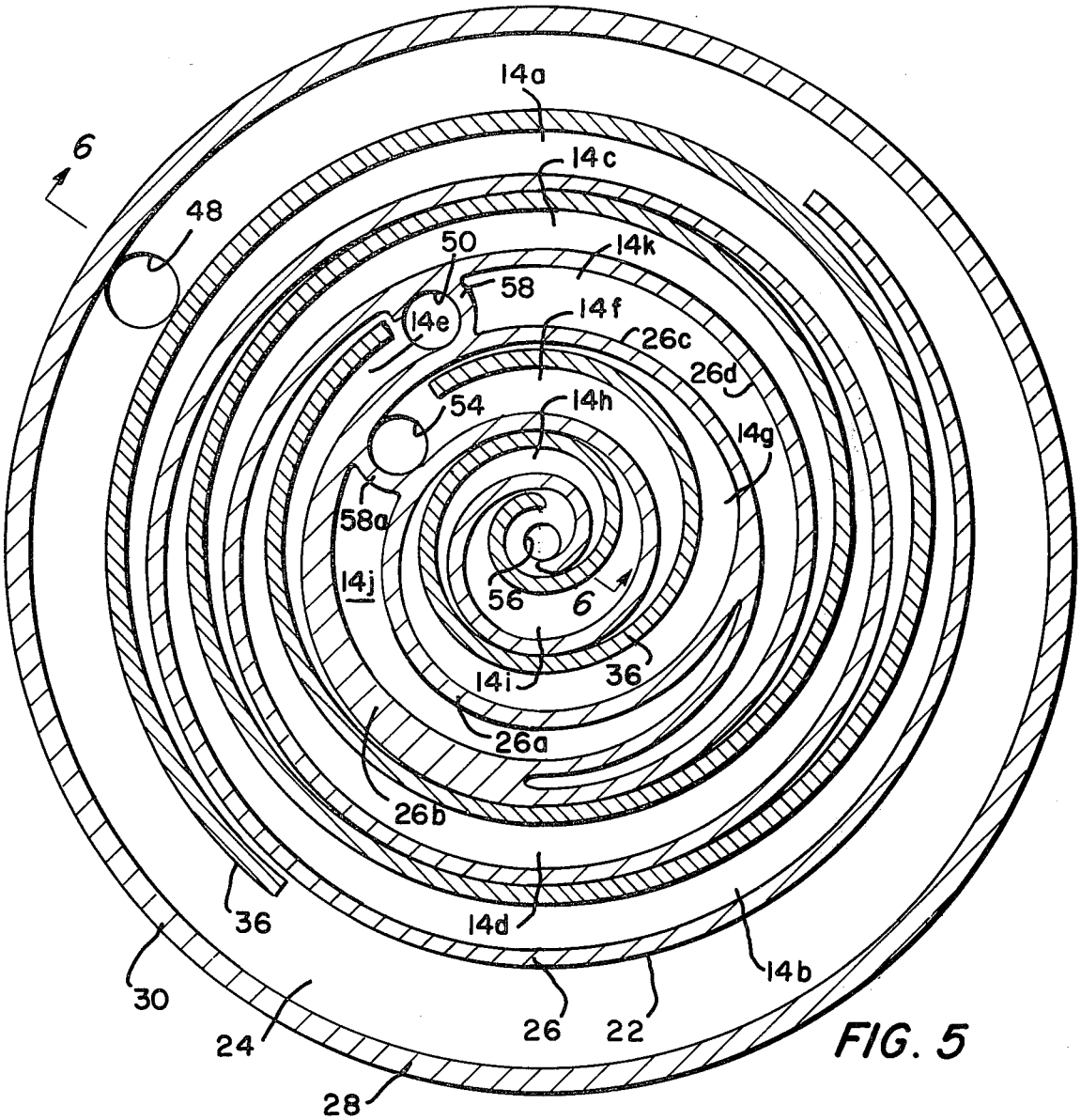
FIG. 5 is a cross-sectional view, taken along a plane normal to the scroll axes, of an embodiment of the apparatus according to the invention.
Figure 6:
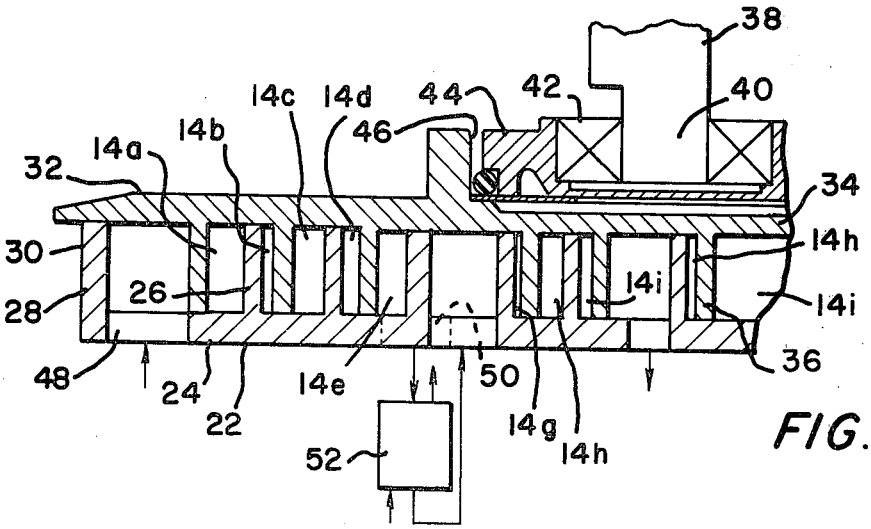
FIG. 6 is a cross-sectional view of the FIG. 5 embodiment taken along section 6—6 of FIG. 5.

FIGS. 5 and 6 depict an embodiment of the invention in which a fixed, scroll-element assembly 22 comprises a substantially flat plate 24 having scroll type involute-wall-forming element 26 projecting upward therefrom as well as a peripheral wall 28. Wall 28 and plate 24 together define a housing 30 in which is carried the fixed, wall-forming scroll element 26. Engaged with assembly 22 is a movable, scroll-element assembly 32, the latter also having a flat plate 34 from which projects a scroll-type involute-wall-forming element 36. As shown in FIG. 6, a drive shaft 38 having an offset crank 40 is received in a bearing 42 which is supported in a bearing housing 44. The latter is fitted into an annular recess 46 formed on the uppermost portion of the plate 34, by means of which the movable, scroll-element assembly 32 is caused to orbit relative to the fixed, scroll-element assembly 22. FIG. 5, in the depicted positioning of the scroll elements there shown, illustrates nine pockets 14*a* through 14*i* for the fluid in which five pockets 14*a* through 14*e* comprise the first stage and the four innermost pockets 14*f* through 14*i* comprise the second stage.

Fluid, by way of example: gas, is admitted into a first zone of the apparatus via an outermost inlet port 48 formed in the fixed scroll plate 24. Thus, the first two outermost pockets 14*a* and 14*b* will enclose the fluid, compress it, and move it spirally or circularly inward until the compressed fluid reaches a vent port 50 — also formed in plate 24. The initially compressed gas is discharged from pockets 14*d* and 14*e*, expelled through the vent port, conducted through a cooler 52, and returned through a second inlet port 54 (into pockets 14*f* and 14*g*) for final compression in the smaller, innermost fluid pockets 14*f* through 14*i* and final discharge through an outlet port 56 located centrally of the apparatus in a second zone thereof. Thus, by this arrangement, the improved apparatus, through the use of only two scroll elements 26 and 36 effects two-stage compression, and accommodates for inter-stage cooling.

The movable scroll element 36 arranges for two-stage compression in that its wall-forming scroll configuration is interrupted and then continued before and after the intermediate vent port 50 and the second inlet port 54, respectively. On the other hand, the fixed scroll element 26 is continuous; however it has two inactive or dead pockets 14*j* and 14*k* formed therewithin of pairs of arcuate walls 26*a* through 26*d*, so that the latter will provide wall surfaces for the active fluid pockets. To insure that the fluid product is not conducted into these dead pockets, arcuate partitions 58 and 58*a* are provided in the fixed scroll element 26 to bridge across the walls 26*a* and 26*b*, and 26*c* and 26*d*.

Figure 7:
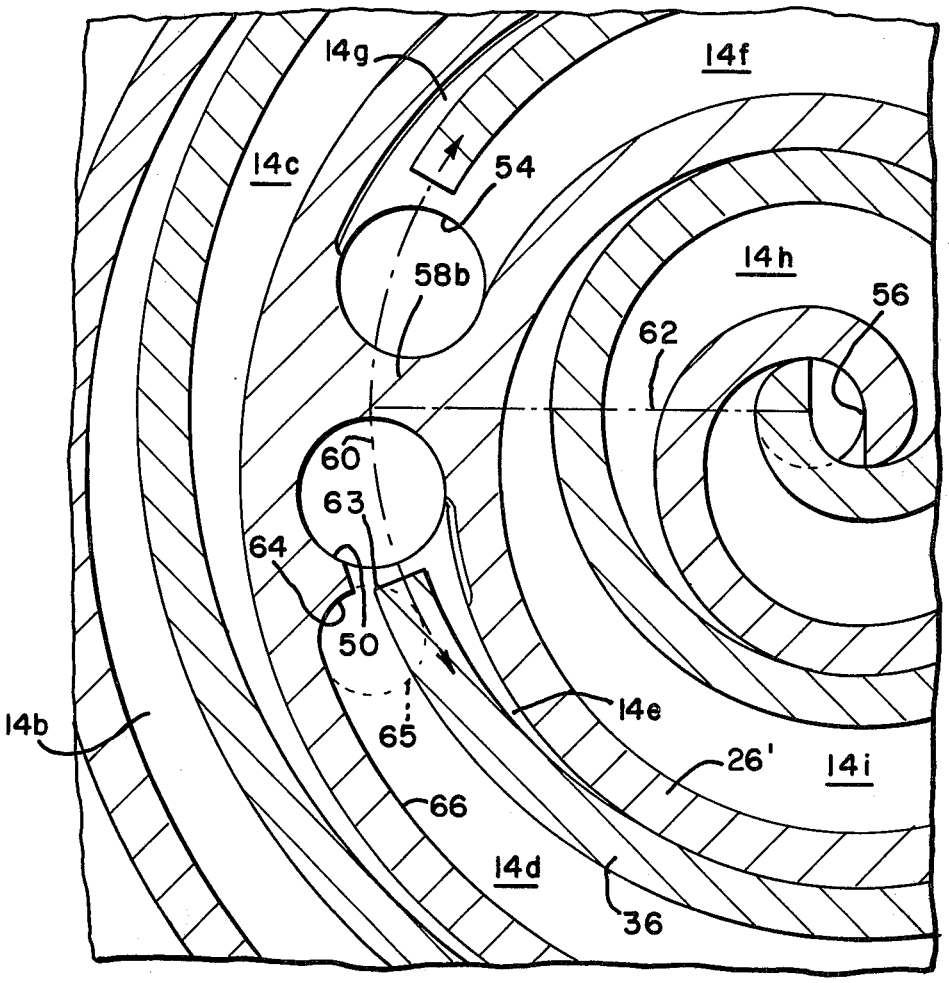
FIG. 7 is a cross-sectional view like that of FIG. 5, except in greater scale, of a portion of an alternative embodiment of the invention.

In an alternative embodiment of the novel apparatus, as shown only partially in FIG. 7, the inactive or dead pockets (14*j*, 14*k*, FIG. 5) are eliminated. In this latter embodiment, the apparatus has a same interrupted movable scroll element 36, however the fixed scroll element 26' is somewhat altered and simplified. In lieu of the inactive or dead pockets, and the two arcuate, bridging partitions 58 and 58*a* (FIG. 5), this embodiment employs a single bridging partition 58*b*. Partition 58*b* separates the vent port 50 (of the first stage) from the inlet port 54 (of the second stage). Too, as can be seen in FIG. 7, both ports are substantially bisected by an arcuate line 60 which is defined by a radius 62 drawn from the center of outlet port 56. This alternative arrangement, besides simplifying the structure and configuration of fixed scroll element 26', and eliminating the non-productive dead pockets, provides the benefit of pressure-balancing active pockets 14*d* and 14*e*.

Also there can be seen on the fixed scroll element of FIG. 7, a section 64 which is the arc of a circle 65. The circumference of the circle 65 is tangent to the inside wall of the involute 66, and has a diameter equal to the orbiting radius of the orbiting scroll element. It can also be seen that the locus of point 63 on the orbiting scroll element as the orbiting scroll moves is also circle 65. This configuration can be seen to delay the parting of pocket 14*d* by approximately 90° of orbit. This unique feature will allow the pressure in pocket 14*d* to equalize with the pressure in pocket 14*e* before discharging into port 60. The configuration shown in FIG. 7 comprises an apparatus for compressing gas in which the movable scroll element 36 orbits in a clockwise fashion and, as noted in the foregoing, point 63 on the moving scroll element 36 maintains a sealing contact with the arcuate section 64 for approximately 90° of orbit. As a consequence there occurs a delayed opening of pocket 14*d*. Conversely, then, when the apparatus is used as an expander, the movable scroll 36 will orbit counterclockwise. Pocket 14*d* will close early, in that point 63 effects an early, sealing engagement with the arcuate section 64.

While we have described our invention in connection with specific embodiments thereof, it is to be clearly understood that this is done only by way of example, and not as a limitation to the scope of our invention as set forth in the objects thereof and in the appended claims.

We claim:

1. An improved, scroll-type, positive fluid displacement apparatus, having means defining a circular and walled, fluid-working chamber, at least one fixed and one movable scroll-shaped, fluid-working element within said chamber, a first port opening into, and substantially centrally of, said chamber, a second port opening into said chamber radially outwardly-spaced from said first port, and means coupled to said one movable scroll-shaped, fluid-working element for moving the latter in an orbit relative to, and interfittingly with, said fixed element, to effect moving line contacts between said elements which define inter-element, walled, variable-volume pockets which, during orbit, close off, and move progressively and circularly, from one of said ports toward the second of said ports for opening of said pockets onto, and for communication thereof with, said second port, wherein the improvement comprises:

means, intermediate of, and spaced-apart from, both said first and second ports, for venting fluid from at least one of said pockets; and means, intermediate of, and spaced-apart from, both said first and second ports, for introducing fluid into at least one other of said pockets prior to a communication of said other pocket with said second port; wherein an end of said one movable element terminates in adjacency to at least one of said fluid-venting and fluid-introducing means, said end, during orbit thereof, moves along a circular path having a given diameter, and said end slidably and sealingly effects and maintains a line contact with a surface formed on said other fixed element, during a given portion of movement of said end about approximately 90° of said orbit, to cause given ones of said pockets, which are defined and sealingly closed off by said line contact between said surface of said fixed element and said end of said one movable element, to experience a closure thereof, to said one of said fluid-venting and fluid-introducing means, which is advanced a period of time which substantially corresponds with the time transpiring during said 90° of orbit.

2. An improved, scroll-type, positive fluid displacement apparatus, having means defining a circular and walled, fluid-working chamber, at least one fixed and one movable scroll-shaped, fluid-working element within said chamber, a first port opening into, and substantially centrally of, said chamber, a second port opening into said chamber radially outwardly-spaced from said first port, and means coupled to said one movable scroll-shaped, fluid-working element for moving the latter in an orbit relative to, and interfittingly with, said fixed element, to effect moving line contacts between said elements which define inter-element, walled, variable-volume pockets which, during orbit, close off, and move progressively and circularly, from said second port toward said first port for opening of said pockets onto, and for communication thereof with, said first port, wherein the improvement comprises:

means, intermediate of, and spaced-apart from, both said first and second ports, for venting fluid from at least one of said pockets; and means, intermediate of, and spaced-apart from both said first and second ports, for introducing fluid into at least one other of said pockets prior to a communication of said other pocket with said first port; wherein an end of said one movable element terminates in adjacency to at least one of said fluid-venting and fluid-introducing means, said end, during orbit thereof, moves along a circular path having a given diameter, and said end slidably and sealingly effects and maintains a line contact with a surface formed on said other fixed element, during a given portion of movement of said end about approximately 90° of said orbit, to cause given ones of said pockets, which are defined and sealingly closed off by said line contact between said surface of said fixed element and said end of said one movable element, each to experience an opening thereof, onto said one of said fluid-venting and fluid-introducing means, which is delayed a period of time which substantially corresponds with the time transpiring during said 90° of orbit.

3. Apparatus, according to claim 2, wherein:

said fluid-venting and fluid-introducing means comprise means for venting fluid from some of said pockets intermediate said first and second ports, and for re-admitting such vented fluid into others of said pockets prior to movement of said other pockets to said first port.

4. Apparatus, according to claim 3, further including:

means coupled to said fluid venting and re-admitting means for cooling fluid vented thereby prior to readmittance thereof into said other pockets.

5. Apparatus, according to claim 2, wherein:

said fixed, scroll-shaped, fluid-working element comprises a flat, substantially circular plate; and said fluid venting and re-admitting means comprise intermediate port means formed in said plate for a conduct of fluid therethrough.

6. Apparatus, according to claim 5, wherein:

said first port comprises means for discharging fluid from said chamber, and comprises a discharge port formed in said plate substantially centrally thereof;

said second port comprises means for admitting fluid into said chamber, and comprises an inlet port formed in said plate a given distance from said discharge port; and said fluid venting and re-admitting intermediate port means is formed in said plate at a radial distance from said discharge port which is less than said given distance.

7. Apparatus, according to claim 2, wherein:

said chamber has a radial center;

said movable, scroll-shaped, fluid-working element is of spiral configuration having progressively diminishing radii, relative to said radial center, ranging from a given major radius to a given minor radius, and further having at least one discontinuity therein intermediate said major and minor radii.

8. Apparatus, according to claim 7, wherein:

said movable scroll-shaped fluid-working element of spiral configuration describes at least one spiral turn of 360° of arc before defining said discontinuity therein.

9. Apparatus, according to claim 7, wherein:

said movable scroll-shaped fluid-working element of spiral configuration describes at least two spiral turns of 360° of arc before defining said discontinuity therein.

10. Apparatus, according to claim 7, wherein:

said movable scroll-shaped fluid-working element of spiral configuration describes at least two spiral turns of 360° each, one thereof being radially outward of said discontinuity and the other thereof being radially inward of said discontinuity.

11. Apparatus, according to claim 7, wherein:

said movable scroll-shaped fluid-working element of spiral configuration describes at least two pairs of spiral turns of 360° arc, one pair thereof being radially outward of said discontinuity and the other pair thereof being radially inward of said discontinuity.

12. Apparatus, according to claim 7, wherein:

said fluid venting and introducing means comprises intermediate port means disposed in adjacency to said discontinuity.

* * * * *

UNITED STATES PATENT OFFICE

CERTIFICATE OF CORRECTION

Patent No. 4,141,677 Dated Feb. 27, 1979

Inventor(s) H. William Weaver et al.

It is certified that error appears in the above-identified patent and that said Letters Patent are hereby corrected as shown below:

Column 2, line 47, change "moving" to -- guiding --; and

Column 6, lines 23 and 24, change "moving" to -- guiding --.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*